US006529171B1

(12) United States Patent
Le Balier et al.

(10) Patent No.: US 6,529,171 B1
(45) Date of Patent: Mar. 4, 2003

(54) VERTICAL POLARIZATION ANTENNA

(75) Inventors: Jean-Yves Le Balier, Trignac (FR); Armel Le Bayon, La Baule (FR); Daniel Nedelec, Saint Nazaire (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/959,842

(22) PCT Filed: May 9, 2000

(86) PCT No.: PCT/FR00/01241

§ 371 (c)(1),
(2), (4) Date: Nov. 9, 2001

(87) PCT Pub. No.: WO00/69019

PCT Pub. Date: Nov. 16, 2000

(30) Foreign Application Priority Data

May 10, 1999 (FR) ..... 99 05924

(51) Int. Cl.[7] ..... H01Q 1/38; H01Q 9/28; H01Q 21/08

(52) U.S. Cl. ..... 343/795; 343/818

(58) Field of Search ..... 343/795, 793, 343/800, 815, 810, 812, 813, 818; H01Q 9/00, 1/36, 1/38

(56) References Cited

U.S. PATENT DOCUMENTS

| | | | | |
|---|---|---|---|---|
| 2,726,388 A | | 12/1955 | Kandoian et al. | 343/774 |
| 3,969,730 A | | 7/1976 | Fuchser | 343/770 |
| 5,285,212 A | | 2/1994 | McNiece | 343/795 |
| 5,917,455 A | * | 6/1999 | Huynh et al. | 343/795 |

FOREIGN PATENT DOCUMENTS

FR 1326096 8/1963

OTHER PUBLICATIONS

M. Akimoto et al, "Characteristics of a Bidirectional Printed Dipole Antenna for Street–Microcellular Systems", IEEE Vehicular Technology Conference, US, NY, IEEE, vol. Conf. 46, 1996, pp. 357–361, XP000594310.

* cited by examiner

*Primary Examiner*—Michael C. Wimer
(74) *Attorney, Agent, or Firm*—Sughrue Mion, PLLC

(57) ABSTRACT

The invention concerns a vertical polarisation antenna comprising dipoles at different levels of an elongated vertical support structure. The invention is characterised in that it comprises only one of said dipoles (1, 2) per level of said structure (3) and said dipoles are coplanar and substantially collinear on said structure, but inverted with respect to one another.

10 Claims, 4 Drawing Sheets

VERTICAL POLARIZATION ANTENNA

BACKGROUND OF THE INVENTION

The present invention relates to vertical polarization antennas having a vertical support structure of elongate shape and dipoles situated at various levels along the structure and coupled to a coaxial feeder cable.

The document WO 97/45892 discloses an antenna of the above kind, in particular an antenna that is omnidirectional in azimuth, having at least two dipoles situated at the same level on the vertical structure. The dipoles and the associated feeder arrays from the coaxial cable are integrated into the structure and constitute a symmetrical system.

The structure of this prior art antenna consists of two identical metal sections which are parallel to each other and at a clearly defined distance from each other and are therefore assembled by means of insulative seals. The sections each have a central part in the form of a longitudinal trough and two opposed and plane lateral branches. They are assembled together back-to-back with the two troughs facing outward and their plane branches disposed face-to-face in pairs and separated by the defined distance between the sections.

The dipoles and their associated feeder arrays are machined into the plane branches of the two sections, the two arms of each dipole being machined into two branches assembled together face-to-face and being suitably bent to constitute the dipole when the two sections are assembled together.

The coaxial feeder cable is terminated at one end of the above structure. Its outer conductor is electrically connected to a first of the two sections. Its inner conductor is electrically connected to an auxiliary conductor mounted in the trough of the same first section and held at a distance from the walls of the trough to reconstitute the coaxial feeder structure. It extends in this way to half the height of the first section, at which point it is connected to the second section by a coaxial connector, to enable symmetrical feeding of the dipoles situated on either side of the median transverse plane of the antenna structure, forming a symmetricalizer system.

The above kind of antenna generates a vertically polarized signal, which is omnidirectional in azimuth if the antenna includes at least two dipoles at each vertical level. It generates a vertically polarized signal which is directional in azimuth if the antenna includes only one dipole at each vertical level.

The vertically polarized azimuth signal from the above antenna also has a crossed polarization component which is horizontal and inherent to vertical polarization antennas with dipoles and is due in particular to the radiation from the horizontal metal parts of the antenna. This horizontal component of polarization, although weaker than the main vertical component and generally at a level of the order of 12 to 15 dB below the latter, is undesirable in itself because it may interfere with other types of antenna nearby.

The prior art antenna previously cited is also relatively complex and costly to make. Furthermore, it can be used only at low and medium frequencies because of its mechanical construction.

SUMMARY OF THE INVENTION

An object of the present invention is to provide a vertical polarization antenna of simple design and whose design minimizes the crossed horizontal polarization component.

Another object of the present invention is to enable the antenna to be made either as a mechanical structure or as a printed circuit, for use at low and medium frequencies or at microwave frequencies.

The present invention provides a vertical polarization antenna including a vertical support structure of elongate shape and dipoles situated at different levels along said structure and coupled to a coaxial feeder cable, characterized in that it includes only one of said dipoles per level and in that said dipoles are coplanar and substantially colinear but inverted with respect to each other on a face of the antenna referred to as the front face.

Said antenna can also have at least one of the following additional features:

- Said dipoles are divided into two groups and inverted from one group to the other.
- The antenna includes a ground plane disposed laterally relative to each group of dipoles and coplanar therewith and a feeder line disposed laterally relative to each group of dipoles and situated in a plane separate from but parallel to the ground plane, said ground plane and said feeder line each having a first section on a first side and along one of said groups of dipoles, a second section on the other side and along the other group, and a median continuity section passing between the two groups, and further includes projections provided on said first and second sections of said ground plane and said feeder line and connected to said dipoles.
- Said coaxial feeder cable extends against said ground plane as far as a mid-point of the median section of said ground plane and is connected to a corresponding mid-point of the median section of said feeder line by a coaxial output provided between said mid-points of said ground plane and said feeder line.
- The antenna includes a reflector associated with said dipoles and mounted to face one face of said structure which is opposite that forming said front face of the antenna.

BRIEF DESCRIPTION OF THE DRAWINGS

The features and advantages of the present invention will emerge from the description of one preferred embodiment shown in the accompanying drawings.

In the drawings.

DETAILED DESCRIPTION OF THE INVENTION

Figure 1:
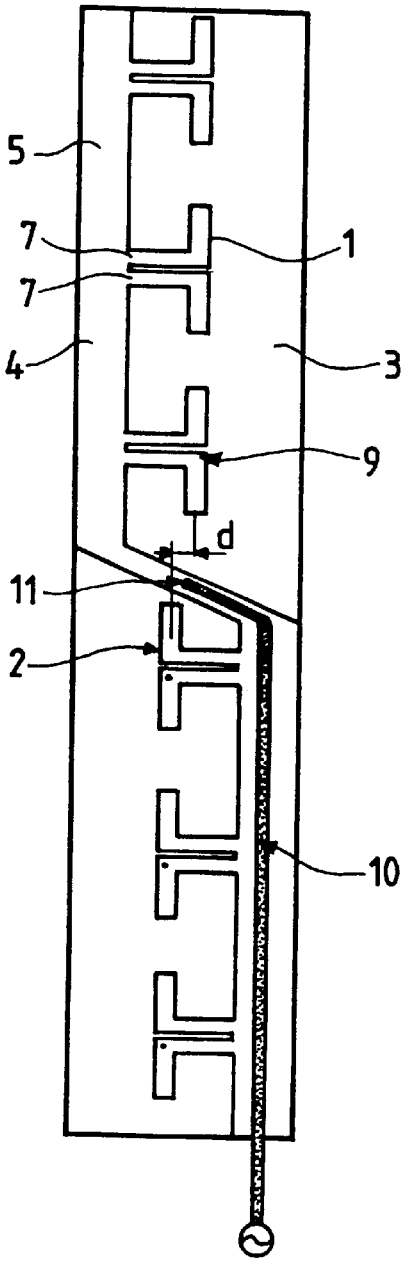
FIGS. 1 and 2 are a front view and a back view of an omnidirectional antenna according to the present invention.
Figure 2:
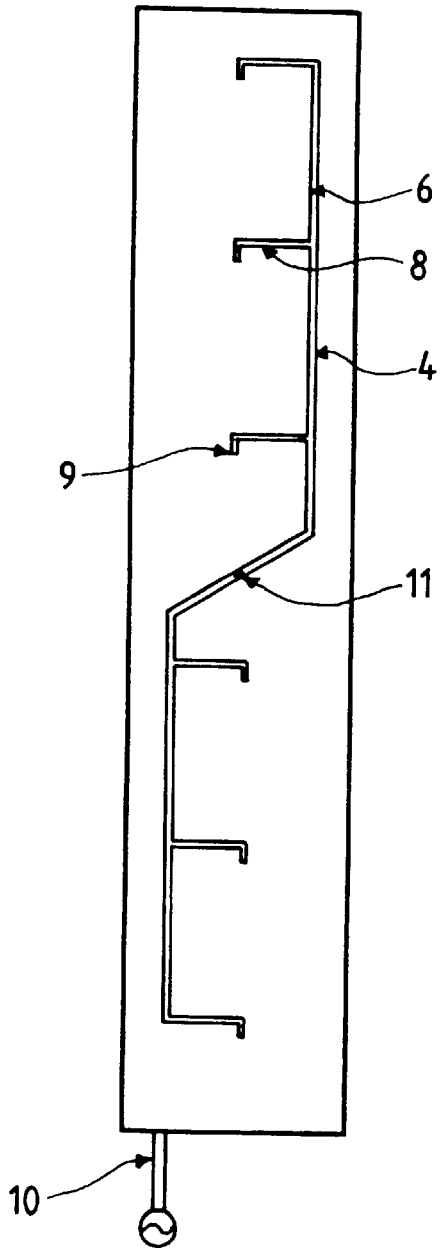

The omnidirectional antenna shown in FIGS. 1 and 2 is of printed construction. It can equally well be of assembled mechanical construction.

It includes an arrangement of six half-wave dipoles 1 or 2 which are coplanar and substantially colinear and are inverted with respect to each other. The dipoles are printed on a front face of a dielectric substrate 3 of elongate shape and of adequate mechanical strength, constituting the support structure of the antenna. The dipoles are organized into two identical groups (of six each) along the substrate, being designated 1 or 2 according to the group to which each of them belongs and being inverted from one group to the other.

The antenna is planar and combines two unit antenna systems each having the some number of dipoles, i.e. half the number of dipoles of the resulting antenna, to obtain a quasi-omnidirectional diagram of the resulting antenna.

Of course, the antenna can have any number of dipoles to obtain the required gain.

The substrate 3 also carries feeder arrays 4 for the dipoles printed on both faces of the substrate. The feeder arrays define a ground plane 5 on the front face of the substrate and a feed line 6 on the rear face. They are in lateral corresponding relationship along the two groups of dipoles and have substantially quarter-wave horizontal projections 7 and 8 to feed the dipoles.

The ground plane 5 and the feeder line 6 each include two opposed analogous sections along and substantially half the length of the first edge and the second edge of the substrate, respectively, and a median continuity section that is slightly skewed from the first preceding section to the second, passing between the two groups of poles. The horizontal projections 7 that start from the ground plane are provided side-by-side in pairs, are referred to as double projections, and therefore terminate directly at the two arms of the dipoles. The horizontal projections 8 that start from the feed line are simple and connected to only one of the arms of the dipoles, by welded metal inserts 9 passing through the substrate.

A coaxial cable 10 provides the feed to a mid-point 11 of the antenna. It extends along the ground plane 5 as far as the mid-point, and is masked by the ground plane. It is welded to the ground plane to retain it mechanically and to make the electrical connection between its outer conductor and the ground plane. Its inner conductor is soldered to the feed line 6 via a coaxial output at the mid-point 11 and designated by the same reference number as that mid-point. The coaxial output is provided by a passage through the substrate and corresponding local demetallization slightly larger than the ground plane.

The antenna is therefore fed at its center, directly by the coaxial feeder cable, to ensure symmetrical and in-phase feeding of the various dipoles.

FIG. 1 shows that the two groups of dipoles have a small center distance of axes d. The center distance of axes d aligns the phase centers of the dipoles of the two groups to compensate their slight offset due to the effect of the ground plane on the dipoles. The value of the center distance of axes is very small, of the order of a few millimeters. It depends on the operating frequency of the antenna, and is in practice adjusted as a function thereof. The center distance of axes adjusted in this way minimizes fluctuation affecting the signal radiated by the antenna, reducing it to less than 2 dB relative to the maximum radiation from the antenna.

The antenna is mounted in a protective radome, not shown but of the kind routinely used. The cylindrical radome can have a lightning arrestor spike connected by a section of cable to the ground plane of the antenna.

Figure 3:
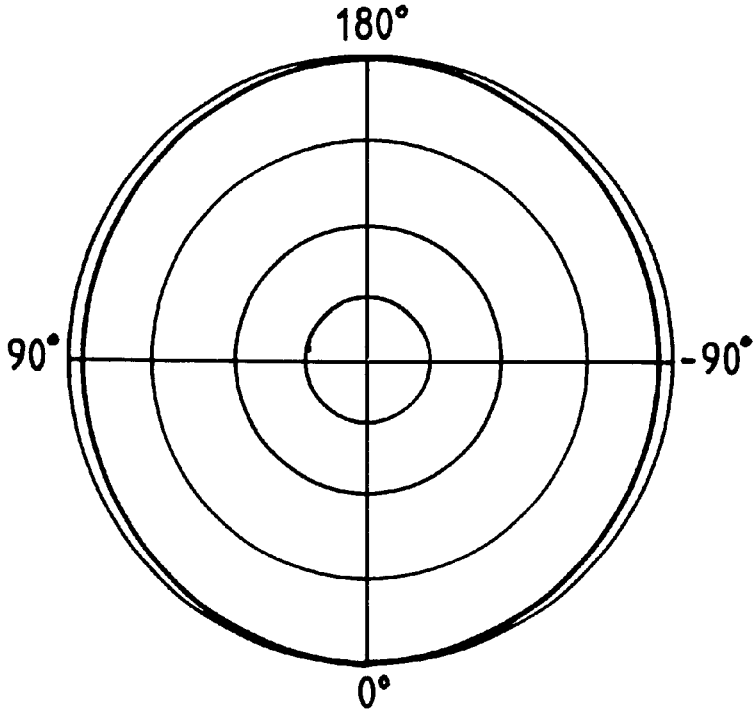
FIG. 3 shows the azimuth radiation diagram of the antenna from FIGS. 1 and 2.

FIG. 3 shows the radiation diagram of the antenna in azimuth, to a scale of 5 dB per division. It shows that its radiation in azimuth is quasi-omnidirectional, having only small fluctuations that are limited and less than 2 dB relative to the maximum radiation, on both sides of the antenna corresponding to the angular positions designated 90° and −90°.

Figure 4:
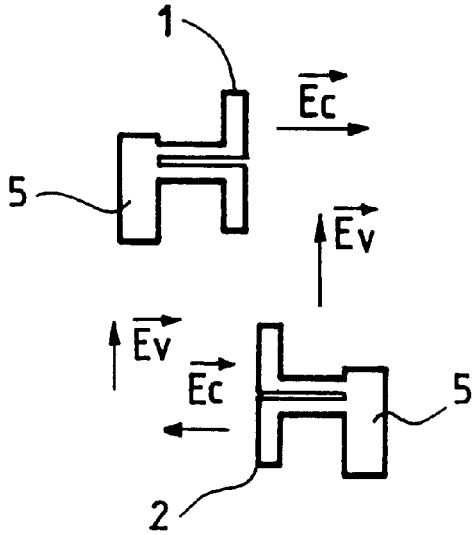
FIG. 4 shows the operation of the antenna from FIGS. 1 and 2.

FIG. 4 shows how the vertical polarization of the signal radiated by the antenna is obtained, resulting from adding vertical components Ev of polarization of the signals from its various dipoles. The figure also shows that horizontal components Ec of polarization of the signals from two inverted dipoles are opposite and therefore tend to cancel out. In practice this enables a vertical polarization antenna to be obtained in which the crossed or horizontal component is very weak and is at a level of the order of 20 dB below the vertical polarization.

The above antenna can be used at all frequencies for which the dipole elements can be made, and thus with a mechanical construction for low and medium frequencies, for example, and a printed construction for microwave frequencies.

Independently of the characteristics of its radiation indicated with reference to FIGS. 3 and 4, the planar shape of the antenna makes it compact and light in weight. Thus the dimensions of the printed circuit antenna used at 3.5 GHz are 330×60×1.5 mm, for example.

Its very simple design enables fast assembly and very good reproducibility of the antenna, reducing its cost. Thus assembly of the printed circuit antenna is confined to fitting the coaxial feeder cable. Assembling a mechanical construction antenna of course involves the preliminary operation of suitably assembling a machined metal plate which reproduces the printed circuit on the front face of the antenna described above and a feeder line which is provided with its horizontal projections and is insulated like its projection from the metal plate.

Figure 5:
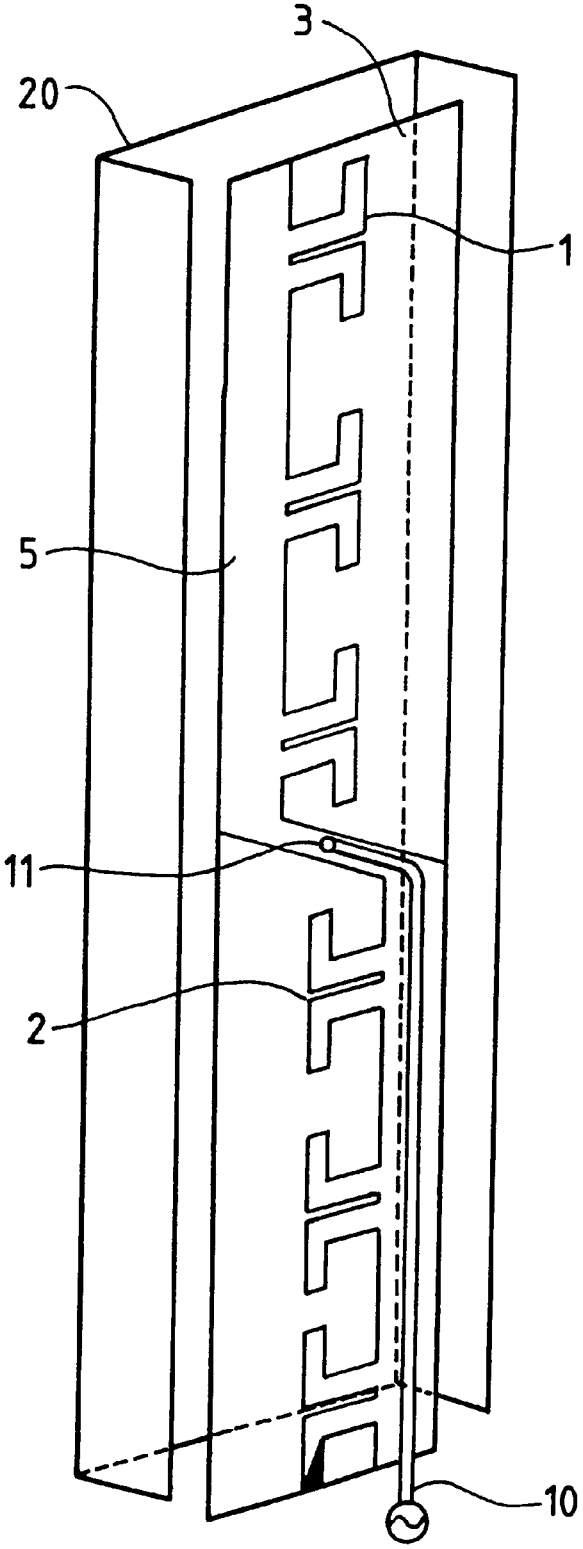
FIG. 5 shows an adaptation of the antenna from FIGS. 1 and 2 previously cited to constitute a directional antenna according to the invention.

FIG. 5 shows a directional antenna formed by adding a reflector 20 to the omnidirectional antenna from FIGS. 1 and 2, the main reference numbers of the omnidirectional antenna previously cited being used again in FIG. 5. The reflector 20 is placed near and to the rear of the substrate 3. In FIG. 5 it has a U-shaped cross section with the edges of its lateral branches substantially flush with the substrate.

The reflector can instead be placed in front of the substrate, in which case the radiation from the dipole elements passes through the substrate.

Figure 6:
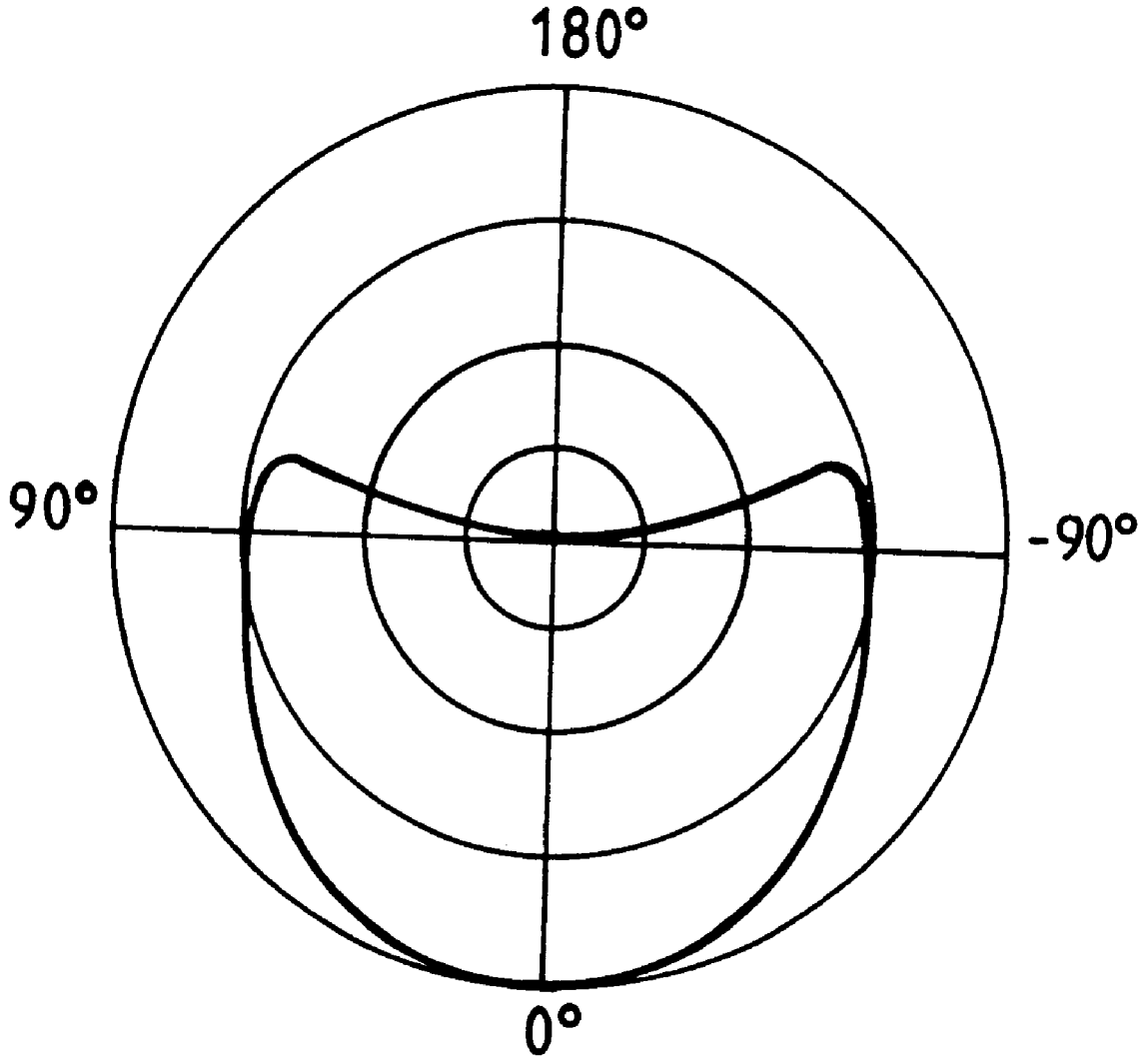
FIG. 6 is the radiation diagram of the directional antenna from FIG. 5.

As shown in FIG. 6, the radiation diagram of the antenna from FIG. 5 in azimuth is rendered directional by deforming and precisely orienting the omnidirectional radiation diagram shown in FIG. 3 of the original antenna without the reflector.

Note also, with regard to the directional antenna, that the shape, size and position of its reflector deform the omnidirectional radiation diagram of the original antenna to a greater or lesser degree to obtain the required directional diagram in azimuth. The signal from the directional antenna is vertically polarized and has a very low level of crossed polarization, like that of the original omnidirecional antenna with no associated reflector.

The directional antenna also has the same advantages as the omnidirectional antenna previously cited.

What is claimed is:

1. A vertical polarization antenna including a vertical support structure of elongate shape and a plurality of dipoles situated at different levels along said structure and coupled to a coaxial feeder cable, characterized in that said antenna includes only one of said dipoles (1, 2) per each of said levels along said structure (3); and in that all of said dipoles are coplanar but are equally divided into two groups, one above the other, so that, when the antenna is used for transmission, inherent horizontal polarization components of the two groups are opposed and tend to cancel each other, said antenna further including a ground plane (5) disposed laterally relative to each group of dipoles, said ground plane having a first section, extending on and along a first lateral side of said one of said groups of dipoles, and a second section extending on and along a second, opposite side of the other of said two groups of dipoles.

2. An antenna according to claim 1, wherein said ground plane (5) is coplanar with said each group of dipoles, and characterized in that said antenna further includes a feeder line (6) also disposed laterally relative to each group of dipoles and situated in a plane separate from but parallel to the ground plane, said feeder line also having a first section, extending on and along said first side of said one group of dipoles, and a second section on said second, opposite side of said other group, and a median continuity section passing between the two groups, and further includes projections (7, 8) provided on said first and second sections of said ground plane and said feeder line and connected to said dipoles (1, 2).

3. An antenna according to claim 2, characterized in that said coaxial cable (10) extends against said ground plane (5) as far as a mid-point (11) of a median section of said ground plane and is connected to a corresponding mid-point of the median section of said feeder line (6) by a coaxial output provided between said mid-points (11) of said ground plane and said feeder line.

4. An antenna according to claim 3, characterized in that the dipoles of the first and second groups are aligned with respective first and second axes having a center distance of axes (d) between them whose value is limited to a few millimeters and is adjusted as a function of the operating frequency of said antenna.

5. An antenna according to claim 3, characterized in that said structure (3) is a dielectric support and in that said dipoles (1, 2), said ground plane (5) and said projections (7) thereof are printed on one face of said dielectric support referred to as the front face of the antenna, and said feeder line (6) and said projections (8) are printed on the other face of said dielectric support.

6. An antenna according to claim 3, characterized in that said structure (3) is a metal support into which said dipoles (1, 2), said ground plane (5) and said projections (7) thereof are directly integrated, and in that said feeder line (6) and said projections (8) thereof are assembled to a face of said metal support referred to as its rear face and insulated therefrom.

7. An antenna according to claim 5, characterized in that it includes a reflector (20) associated with said dipoles (1, 2) and mounted to face that face of said structure that is opposite that forming said front face of the antenna or facing said front face.

8. The antenna according to claim 1, wherein the dipoles of said one group are inverted with respect to the dipoles of said other group.

9. The antenna according to claim 8, wherein said dipoles are divided into only two said groups.

10. The antenna accordance to claim 9, wherein said antenna is free of any phase adjustment mechanism.

* * * * *